US005515698A

United States Patent [19]

Sawazaki et al.

[11] Patent Number: 5,515,698

[45] Date of Patent: May 14, 1996

[54] APPARATUS FOR REMOVING AND COLLECTING FIBER WASTE FROM A CREEL STAND

[75] Inventors: Masatoshi Sawazaki; Yoshiaki Igarashi, both of Kobe, Japan

[73] Assignee: Precision Fukuhara Works, Ltd., Japan

[21] Appl. No.: 226,768

[22] Filed: Apr. 12, 1994

[30] Foreign Application Priority Data

Apr. 16, 1993 [JP] Japan ..... 5-113602

[51] Int. Cl.[6] ..... D04B 35/32; D04B 15/42; B65H 49/16

[52] U.S. Cl. ..... 66/168; 15/301

[58] Field of Search ..... 66/8, 168; 15/301

[56] References Cited

U.S. PATENT DOCUMENTS

| | | | |
|---|---|---|---|
| 3,018,503 | 1/1962 | Hijiya et al. | 15/301 X |
| 3,018,603 | 1/1962 | Rutz et al. | 15/301 X |
| 3,667,093 | 6/1972 | Culpepper, Jr. | 15/301 X |
| 4,594,845 | 6/1986 | Matsui | 15/301 X |
| 4,719,662 | 1/1988 | Horak et al. | 15/301 |
| 4,784,349 | 11/1988 | Renwick et al. | 15/301 X |
| 4,874,411 | 10/1989 | Snauwaert et al. . | |
| 4,881,957 | 11/1989 | Shofner . | |
| 4,922,691 | 5/1990 | Shen . | |
| 5,327,749 | 7/1994 | Junger | 66/168 X |

FOREIGN PATENT DOCUMENTS

| | | | |
|---|---|---|---|
| 0389045 | 9/1990 | European Pat. Off. . | |
| 527707 | 3/1993 | European Pat. Off. | 66/168 |
| 1216120 | 11/1959 | France | 66/168 |
| 2353328 | 12/1977 | France . | |
| 3139608 | 4/1983 | Germany . | |
| 3833434 | 12/1989 | Germany . | |

*Primary Examiner*—John Calvert
*Attorney, Agent, or Firm*—Bell, Seltzer, Park & Gibson

[57] ABSTRACT

Apparatus for removing and collecting fiber waste from a creel stand having multiple, juxtaposed creel sections including an air suction/blower blowing a first air stream across the top of the creel sections and creating a second air stream flowing across the bottom of the creel sections. An air deflector reciprocating across the top of the creel sections deflects the first air stream downwardly through the creel sections. A bottom plenum beneath the creel sections receives the air stream from the creel sections and confines and directs the second air stream to the suction/blower. A second blower blows air through the bottom plenum toward the suction/blower to assist the suction/blower in creating the second air stream. A plurality of baffles are included in the bottom plenum to provide laminar air flow therein.

15 Claims, 2 Drawing Sheets

APPARATUS FOR REMOVING AND COLLECTING FIBER WASTE FROM A CREEL STAND

FIELD OF THE INVENTION

This invention relates to an apparatus for collecting lint, dust and similar material, hereinafter referred to as fiber waste, from a creel stand associated with a knitting machine or machines, and for improving thereby the environmental conditions in a knitting plant or factory.

BACKGROUND OF THE INVENTION

The number of yarn bobbins typically mounted upon a creel stand associated with a knitting machine or machines may number from about 30 to over 100. The quantity of fiber waste generated from the yarns passing from the creel stand is therefore quite large, particularly when the yarn is comprised of cotton. After the fiber waste has become airborne, it will tend to settle upon and adhere to the bobbins or yarns, thereby causing yarn breakage and defects in the fabric being knitted. This, of course, lowers the quality of the fabric, and also impairs the efficiency of the knitting operation.

It has previously been proposed to direct a current of air downwardly from a fan or blower located above the creel stand. This approach is of little benefit, however, since the air flow merely temporarily displaces the fiber waste, and does not collect the same or prevent its migration to adjacent creel stands and/or knitting machines.

It has also heretofore been proposed to enclose the creel stand by a hermetic covering, and to then collect the fiber waste by use of a motor driven fan and waste-collecting filters disposed within the hermetic covering. However, providing a hermetic covering is quite costly, and its presence complicates the knitting operation.

Creel stands for knitting machines are provided in different shapes and sizes. For example, circular creel stands having an inner section that is substantially empty of bobbins and an outer section surrounding the inner section that supports and contains the bobbins are quite commonly used. Similarly, rectangular creel stands having multiple, juxtaposed creel sections are also frequently used. Co-pending application Ser. No. 07/869,305, filed Apr. 16, 1992, owned by the assignee of this application, discloses a fiber waste removal and collection system for circular creels. However, that system is not readily adaptable to rectangular creels having multiple, juxtaposed creel sections.

SUMMARY OF THE INVENTION

The present invention provides a relatively simple and inexpensive apparatus particularly suited for efficiently removing and collecting fiber waste from a rectangular creel stand having multiple, juxtaposed creel sections, as a result of which the environment in the knitting plant or factory is cleaner, yarn breakage and defects in the knitted fabric are reduced, and the productivity and quality of the knitting process and the knitted fabric are improved.

In a preferred embodiment, the fiber waste collecting apparatus of the invention is combined with a creel stand having multiple, juxtaposed creel sections which contain yarn bobbins. Air suction and blowing means is located at one end of the creel stand for blowing an upper air stream across the top of the creel sections and for creating a suction which causes a lower air stream to flow across the bottom of the creel sections. A filter is located between the bottom of the creel sections and the suction and blowing means for filtering fiber waste from the lower air stream. An air deflector for deflecting the upper air stream downwardly through the creel sections is located above the creel sections and is movable relative thereto. The air deflector is moved across the top of the creel sections to ensure that each creel section has the air stream deflected therethrough.

A second blower is preferably located at the other end of the creel stand for blowing air across the bottom of the creel sections to enhance and improve the air flow and fiber waste removal of the air suction and blowing means. In addition, a series of spaced baffles are preferably provided in the bottom of the creel stand to provide a laminar flow of air therein.

DESCRIPTION OF THE DRAWINGS

Other features of the invention will be apparent from the following description of an illustrative embodiment thereof, which should be read in conjunction with the accompanying drawings, in which.

DESCRIPTION OF THE ILLUSTRATED EMBODIMENT

Figure 1:
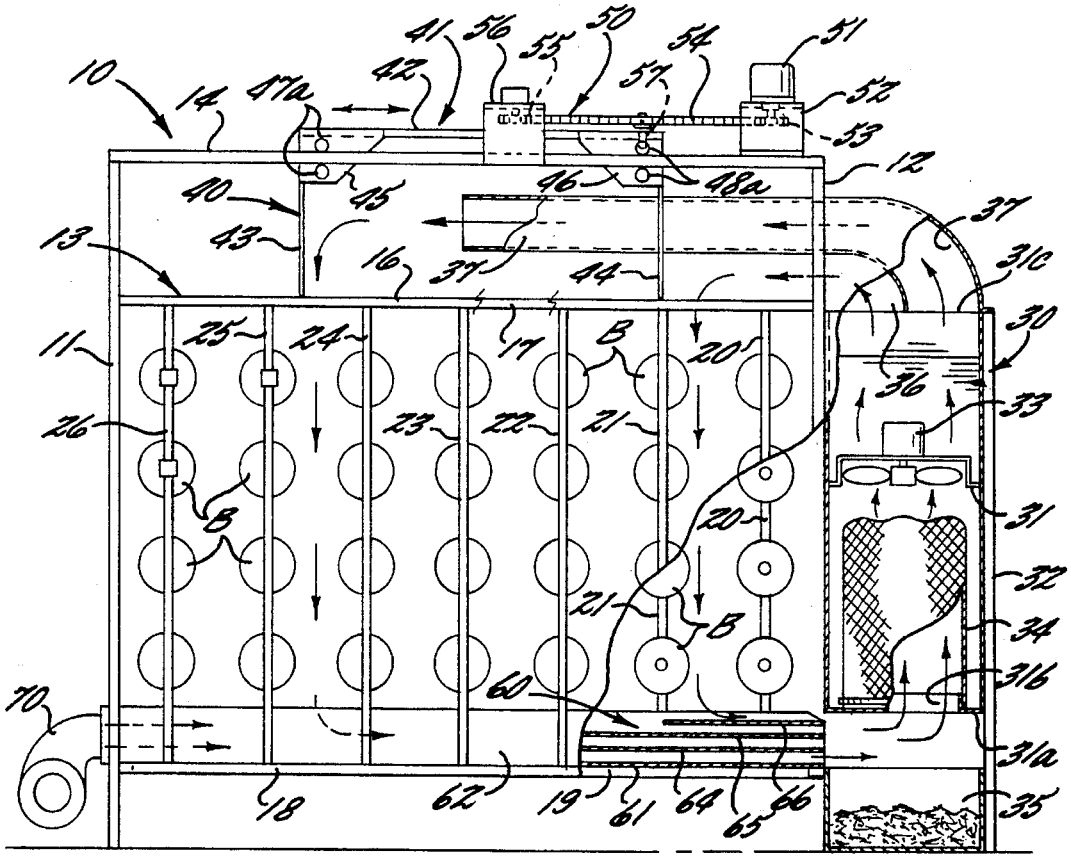
FIG. 1 is a view partially in front elevation and partially in vertical section of an apparatus for removing and collecting fiber waste from a creel stand associated with a circular knitting machine in accordance with the present invention.
Figure 2:
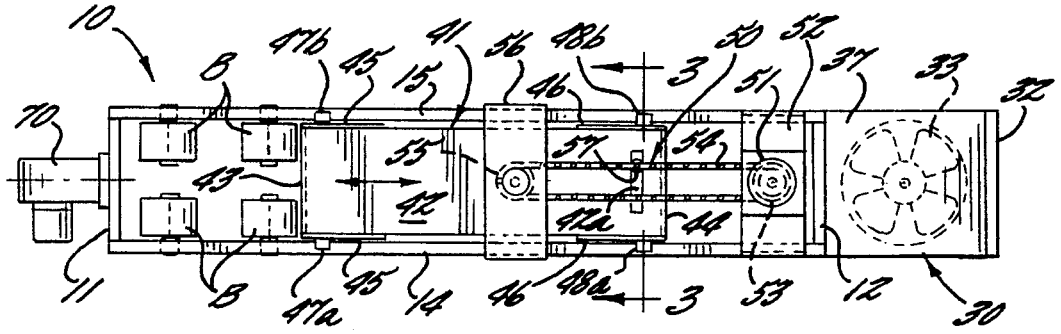
FIG. 2 is a top plan view of the apparatus shown in FIG. 1.
Figure 3:
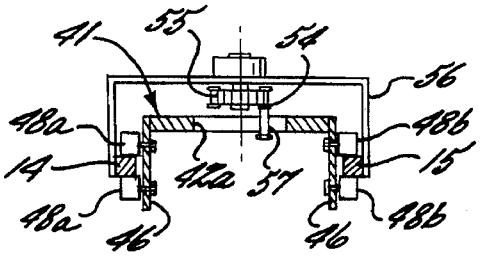
FIG. 3 is an enlarged fragmentary sectional view taken substantially along line 3—3 in FIG. 2.
Figure 4:
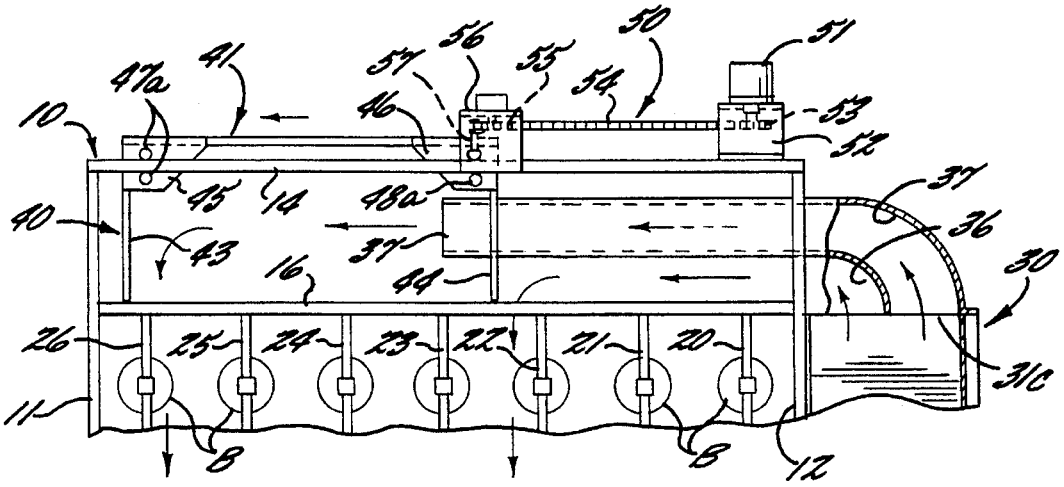
FIG. 4 is an enlarged fragmentary view, partially in vertical section and partially in elevation, of the top portion of the apparatus shown in FIG. 1.

Referring now more specifically to the drawings and particularly to FIG. 1, there is shown a rectangular creel stand generally indicated at 10. Creel stand 10 includes opposite end walls 11 and 12 and an interior framework 13 between and supported by the end walls 11 and 12. Framework 13 includes a pair of spaced apart top frame members 14, 15 supported at their opposite ends on end walls 11, 12; a pair of spaced apart intermediate, horizontal frame members 16, 17 supported at their opposite ends on end walls 11, 12; and a pair of spaced apart bottom frame members 18, 19 also supported by the end walls 11, 12. A plurality of spaced apart pairs of spaced apart vertical frame members 20, 21, 22, 23, 24, 25 and 26 are supported at their opposite ends on intermediate frame members 16, 17 and bottom frame members 18, 19. Vertical frame members 20–26, inclusive, support yarn bobbins B for unwinding and define multiple, juxtaposed creel sections.

Preferably, the top frame members 14, 15 are provided with curtains of vinyl plastic or the like (not shown) which hang down on the outside of the creel sections, but which can be readily moved aside for servicing the creel 10. Such curtains protect the bobbins from airborne fiber waste from the outside of creel 10 and confine the fiber waste generated in creel 10 therein.

The creel stand 10 includes a fiber waste removal apparatus which includes an air suction and blowing means, generally indicated at 30. Air suction and blowing means includes a plenum 31 supported between end wall 12 and a third, partial end wall 32. Plenum 31 is preferably made of sheet metal and is rectangular in cross-section. Plenum 31 has a bottom wall 31*a* which closes the bottom end of plenum 31, except for a central hole 31*b* therein, and is open at its upper end 31*c*.

A fan 33 is mounted in plenum 31 in an upper medial location for blowing air upwardly out of the open end 31*c* of plenum 31 and for creating a suction in the lower portion thereof. A filter 34 is mounted in the lower portion of plenum 31 and has the open end thereof mounted in surrounding relation to hole 31*b* in the bottom 31*a* of plenum 31. Filter 34 filters fiber waste from an air stream drawn into plenum 31 by fan 33. A fiber waste collection bin 35 is located beneath the bottom 31*a* of plenum 31 to catch and collect any fiber waste falling out of the filter 34 through hole 31*b* in the bottom 31*a* of the plenum 31.

The plenum 31 has the open upper end 31*c* thereof connected to the upper portion of the creel stand 10 between the top frame members 14, 15 and intermediate frame members 16, 17 by a first duct 36 and a second duct 37. First duct 36 communicates with the left half of the open end 31*c* of plenum 31 and with the right half of creel stand 10, as seen in FIG. 1, through end wall 12. Second duct 37 communicates with the right half of the open end 31*c* of plenum 31 and extends therefrom to approximately the center of creel stand 10.

An air deflection means 40 is located on the top of creel stand 10 to deflect the air streams from ducts 35 and 36 downwardly through the creel sections. Deflection means 40 includes a carriage 41 having a top member 42 carrying first and second deflector members 43, 44 at opposite ends thereof. Top member 42 has a width substantially the same as the spacing between top frame members 14 and 15 and a length substantially the same as one-half the length of creel stand 10. Deflector members 43, 44 have a width substantially the same as top member 42 and a height such that the lower ends thereof are between the intermediate frame members 16, 17. Deflector member 44 has a hole therethrough which receives duct 36 therein and which permits deflector member 44 to be moved along duct 36 while deflecting air downwardly.

Carriage 41 includes pairs of corner braces 45, 46 at opposite ends of top member 42 and at the upper ends of deflector members 43, 44. Respective pairs of mounting rollers 47*a*, 47*b* and 48*a*, 48*b* are mounted on the pairs of corner braces 45, 46 and straddle the top frame members 14, 15 to mount carriage 41 thereon for reciprocatory movement therealong.

Figure 5:
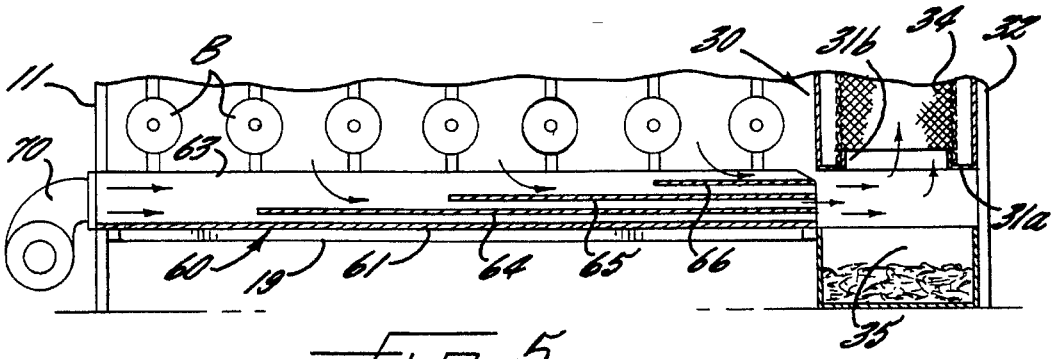
FIG. 5 is an enlarged view, partially in elevation and partially in section, of the bottom portion of the apparatus shown in FIG. 1.

Drive means 50 is connected to carriage 41 to reciprocate the same along top frame members 14, 15. Drive means 50 includes a drive motor 51 mounted on one end of top frame members 14, 15 by a bracket 52. Drive motor 51 has a drive sprocket 53 mounted on the end of the output shaft thereof. A sprocket chain 54 has one end thereof trained about drive sprocket 53 and the other end thereof is supported by an idler sprocket mounted on a bracket 56. Bracket 56 is in turn mounted on the outside of top frame members 14, 15 so as not to interfere with the rollers 47, 48 of carriage 41. Sprocket chain 54 carries a roller 57 from one link thereof for movement therewith. Roller 57 has the lower end thereof disposed in an elongate opening or slot 42*a* in top member 42 of carriage 41. Slot 42*a* has a length transverse of top member 42 greater than the transverse width of sprocket chain A bottom plenum 60 is located in the bottom of creel stand 10 and is preferably made of sheet metal. Bottom plenum 60 has a bottom wall 61 and side walls 62, 63, but no top wall (FIG. 5). A plurality of intermediate walls or baffles 64, 65 and 66 are mounted on side walls 62, 63 and are disposed parallel to bottom wall 61.

Baffle 64 is the longest of the baffles and extends from the right end of bottom plenum 60 adjacent the bottom of plenum 31 to a point substantially equal to three-quarters of the length of creel stand 10. Baffle 65 extends for about one-half the length of creel stand 10, and baffle 66 extends for about one-quarter the length of creel stand 10. Baffles 64, 65 and 66 divide plenum 60 into air flow channels to provide a laminar flow of air therein.

A second fan or blower 70 is preferably connected to the left end of bottom plenum 60. Second blower 70 provides increased air flow through plenum 60 to increase the fiber waste removal and collection efficiency of the apparatus.

In operation, the yarns are unwound from the bobbins B and fed to a circular knitting machine in a conventional manner. Fan 33 operates to blow an air stream upwardly in plenum 31. The air stream from fan 33 is divided into first and second air streams by ducts 36 and 37. The first air stream passes through duct 36 and enters the right-hand half of the top portion of creel 10 above the creel sections, but beneath the duct 37. The second air stream passes through duct 37 and enters the left-hand half of the top portion of creel 10.

The first air stream will travel horizontally until it strikes deflector member 44 which will then deflect the first air stream downwardly into and through the creel section over which the deflector member 44 is positioned. Simultaneously, the second air stream travels horizontally until it strikes deflector member 43 which deflects the second air stream downwardly into and through the creel section over which deflector member 43 is positioned.

Deflector members 43 and 44 are reciprocated, back and forth, along the top portion of the creel as carriage 41 is reciprocated by motor 51 driving sprocket chain 54 which carries roller 57 therewith. Roller 57 pushes carriage 41 by means of the slot 42*a* in member 42. Instead of the unidirectional drive disclosed, a reversible motor with suitable limit switches could be used.

The reciprocal movement of carriage 41 is such that the deflector members 43, 44 are sequentially positioned to direct the air streams downwardly through each creel section of creel 10 twice in each complete cycle of movement of carriage 41. Any fiber waste in the creel sections will be removed from the creel parts and become entrained in the air streams.

The first and second air streams will enter the bottom plenum 60 when they exit the bottoms of the creel sections. Because of the suction created by fan 33 and preferably assisted by second blower 70, the first and second air streams will be turned horizontally and will travel along plenum 60. Depending on the particular creel section through which the air steams have passed, the baffles 64, 65 and 66 will maintain the air streams separate and direct the same along divided paths of travel in the bottom plenum 60.

The air streams will exit the open end of plenum 60 and be turned upwardly into the filter 34, which filters the fiber waste from the air streams. Once the fiber waste in filter 34 builds up to a point where it is heavier than the air streams will support, the fiber waste drops downwardly into the collection box 35 for subsequent removal.

In the drawings and specifications, there has been set forth a preferred embodiment of the invention, and although specific terms are employed, they are used in a generic and descriptive sense only and not for purposes of limitation.

That which is claimed is:

1. Apparatus for removing and collecting fiber waste from a rectangular creel having multiple, juxtaposed sections and a top, bottom and opposite ends for supporting and containing yarn bobbins, said apparatus comprising air suction and blowing means located at one end of the creel for blowing a first air stream across the top of the juxtaposed creel sections and for creating a suction to draw a second air stream across the bottom of said creel sections, filter means located in the second air stream between the bottom of said creel sections and said air suction and blowing means for filtering fiber waste from the second air stream, air deflection means located above the creel sections and in the path of the first air stream for deflecting the first air stream downwardly through the creel sections to said second air stream to remove fiber waste from said sections, means mounting said air deflection means for reciprocatory movement across the top of the creel sections, and means for moving said air deflection means across the top of the creel sections to deflect the air stream sequentially into and through the creel sections.

2. Apparatus according to claim 1 wherein said air suction and blowing means includes duct means for confining and directing the first air stream across the top of the creel sections.

3. Apparatus according to claim 1 including a bottom plenum mounted beneath the creel sections and defining a confined path of travel for the second air stream across the bottom of the creel sections.

4. Apparatus according to claim 3 wherein said bottom plenum includes at least one baffle mounted in said bottom plenum and extending longitudinally for a portion of the length thereof to provide laminar flow of the second air stream in said bottom plenum.

5. Apparatus according to claim 4 wherein said bottom plenum comprises a bottom wall and side walls extending upwardly from said bottom wall to define an open top plenum, said bottom plenum being open at one end which communicates with said air suction and blowing means, and wherein said at least one baffle extends horizontally, parallel to said bottom wall, but in spaced relation thereto, from said open one end of said bottom plenum toward an end thereof opposite said one end for a predetermined distance less than the length of said bottom plenum.

6. Apparatus according to claim 5 wherein a plurality of baffles are mounted in spaced relation to said bottom wall and to each other, and wherein said plurality of baffles are of different lengths.

7. Apparatus according to any one of claims 3–6 including second blower means connected to said bottom plenum at said opposite end of the creel from said one end and said air suction and blowing means for blowing air through said bottom plenum toward said air suction and blowing means.

8. Apparatus according to claim 1 wherein said air deflection means comprises at least one air deflection member vertically mounted in a portion of the creel adjacent said top thereof above the creel sections for blocking the first air stream and deflecting the first air stream downwardly into and through the creel section above which said air deflection member is positioned.

9. Apparatus according to claim 8 wherein said air suction and blowing means includes fan means for creating the first and second air streams and duct means for confining the first air stream and directing the same across the top of the creel sections to said air deflection member.

10. Apparatus according to claim 9 wherein said duct means comprises first and second duct means for dividing the first air stream into two separate air streams and for dividing the first air stream into two separate air streams and for directing the first of the two separate air streams into said top portion of one-half of the creel and for directing the second of the two separate air streams into the other half of the creel, and wherein said air deflection means comprises two spaced apart air deflection members, one mounted in the path of the first of the two air streams and the other mounted in the path of the second of the two separate air streams.

11. Apparatus according to claim 10 wherein said mounting means for said air deflection means comprises a carriage movably mounted on top of the creel and supporting said air deflection members therefrom.

12. Apparatus according to claim 11 wherein said means for moving said air deflection means comprises a sprocket chain mounted at opposite ends thereof by sprockets and connected to said carriage, and a drive motor connected to one of said sprockets for driving said sprocket chain.

13. Apparatus for removing and collecting fiber waste from a rectangular creel having multiple, juxtaposed sections and a top, bottom and first and second ends for supporting and containing yarn bobbins, said apparatus comprising air suction and blowing means located at one end of the creel for blowing a first air stream across said top of the juxtaposed creel sections and for creating a suction to draw a second air stream across said bottom of said creel sections, filter means located in the second air stream between the bottom of said creel sections and said air suction and blowing means for filtering fiber waste from the second air stream, air deflection means mounted on said creel adjacent the top thereof above the creel sections and in the path of the first air stream for deflecting the first air stream downwardly through the creel sections to said second air stream to remove fiber waste from said sections, and bottom plenum means extending across said bottom of the creel sections and communicating with the bottoms of the creel sections and with said air suction and blowing means for confining the second air stream and directing the same across the bottom of the creel sections to said filter means.

14. Apparatus according to claim 13 including second blower means connected to said bottom plenum means at the end of the creel opposite to said air suction and blowing means for blowing air along said bottom plenum means to assist said air suction and blowing means in creating the second air stream.

15. Apparatus according to claim 14 wherein said bottom plenum means includes baffle means for creating a laminar flow of air in the second air stream in said bottom plenum means.

* * * * *

UNITED STATES PATENT AND TRADEMARK OFFICE

CERTIFICATE OF CORRECTION

PATENT NO. : 5,515,698

DATED : May 14, 1996

INVENTOR(S) : Sawazaki et al.

It is certified that error appears in the above-indentified patent and that said Letters Patent is hereby corrected as shown below:

On the title page, Column 2, FOREIGN PATENT DOCUMENTS, line 2, "3/1993" should be --2/1993--.

On the title page, Column 2, add the omitted references:

--"Shelton Launch The Filtafan"; Filiere Maille, September/October 1989.

Shelton Filtafan Creel Leaflet.

Portion of Article in NY Fabric Journal, 1989.--

Column 2, line 62, after "vinyl" insert --,--.

Column 3, line 61, after "sprocket" insert --55--.

Column 4, line 2, after "chain" insert --54.--.

Column 4, line 39, after "creel" insert --10--.

Column 4, line 59, "steams" should be --streams--.

Column 5, line 1, "specifications" should be --specification--.

Signed and Sealed this

Tenth Day of September, 1996

Bruce Lehman

*Attest:*

BRUCE LEHMAN

*Attesting Officer*

*Commissioner of Patents and Trademarks*